US006110887A

United States Patent [19]

Euler et al.

[11] Patent Number: 6,110,887

[45] **Date of Patent: *Aug. 29, 2000**

[54] AQUEOUS FABRIC SOFTENERS HAVING IMPROVED HANDLE

[75] Inventors: Axel Euler, Steinau and der Strasse; Michael Fender, Bad Soden-Salmunster; Hans-Jurgen Kohle, Schluchtern; Hans-Georg Schieber, Bad Soden-Salmunster, all of Germany

[73] Assignee: Witco Surfactants GmbH, Steinau an der Strasse, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/198,181

[22] Filed: Nov. 23, 1998

[30] Foreign Application Priority Data

Dec. 18, 1997 [DE] Germany ..... 197 56 434

[51] Int. Cl.[7] ..... C11D 1/62

[52] U.S. Cl. ..... 510/527; 510/522

[58] Field of Search ..... 510/504, 515, 510/527, 521, 522

[56] References Cited

U.S. PATENT DOCUMENTS

| | | | |
|---|---|---|---|
| 5,437,801 | 8/1995 | Lueders et al. | 252/8.8 |
| 5,705,663 | 1/1998 | Brock et al. | 554/110 |
| 5,726,144 | 3/1998 | Dewez et al. | 510/522 |
| 5,783,534 | 7/1998 | Wahle et al. | 510/124 |
| 5,869,716 | 2/1999 | Pi Subrana et al. | 554/114 |

FOREIGN PATENT DOCUMENTS

| | | |
|---|---|---|
| 664179 A1 | 3/1995 | European Pat. Off. . |
| 91/01295 | 7/1989 | WIPO . |

*Primary Examiner*—John R. Hardee
*Attorney, Agent, or Firm*—Scully, Scott, Murphy & Presser

[57] ABSTRACT

The invention relates to aqueous laundry fabric softener dispersions based on quaternary triethanolamine fatty acid esters having a defined ratio of triethanolamine to fatty acid, the fatty component having a specific degree of saturation.

2 Claims, No Drawings

AQUEOUS FABRIC SOFTENERS HAVING IMPROVED HANDLE

FIELD OF THE INVENTION

The present invention relates to fabric softeners in the form of aqueous emulsions or dispersions.

BACKGROUND OF THE INVENTION

As is known, when washing textiles, fabric softener is used in the final wash. This reduces hardening of the fabric, which is caused by drying. The handle of the textiles treated in this way, such as hand and bath towels and also underwear and bed linen is favorably influenced.

The fabric softeners which are usually used are cationic compounds, for example quaternary ammonium compounds, which, as well as long-chain alkyl radicals, may also contain ester or amide groups, for example as described in U.S. Pat. Nos. 3,349,033, 3,644,203, 3,946,115, 3,997,453, 4,073,735 and 4,119,545. These components are added to the rinsing bath on their own or in mixtures with other cation-active or else neutral substances in the form of aqueous dispersions.

Frequent use is made of ammonium compounds which contain ester bonds, as described, for example, in EP-A-O-, 239,910, and U.S. Pat. Nos. 3,915,867, 4,137,180 and 4,830,771.

Ester compounds based on triethanolamine, such as N-methyl, N,N-bis(beta-$C_{14-18}$-acyloxyethyl), N-betahydroxyethyl-ammonium methosulfate, which are marketed under tradenames such as TETRANYL® AT 75 (trademark of KAO Corp.), STEPANTEX® VRH 90 (trademark of Stepan Corp.) or REWOQUAT® WE 18 (trademark of Witco Surfactants GmbH) are particularly widespread.

Although these cationic compounds are effective softeners when used in the final rinsing bath, they do have certain disadvantages when used.

One of the disadvantages of such compositions is that the required high level of simultaneously good rewetting power and soft handle of the textiles treated therewith is still not satisfactory.

Rewetting power is taken to mean, in general, the absorption of liquid by the fibers. Insufficient rewetting power is, however, disadvantageous where relatively large amounts of liquid are to be absorbed from the surface of the skin, e.g. with hand and bath towels and underwear and bed linen.

Using processes known per se (batch or continuous processes), it is possible to prepare stable fabric softener dispersions using these products.

BRIEF SUMMARY OF THE INVENTION

The object of the invention was to overcome the above-mentioned disadvantages of conventional fabric softener formulations and to provide laundry fabric softeners which, in addition to good biodegradability, have a significantly improved level of good soft handle while retaining a good rewetting power.

The object is achieved using quaternary fatty acid-amino alcohol esters of triethanolamine esterified with partially hydrogenated fatty acids in the ratio triethanolamine:fatty acid of from 1:1.6 to 1:2 in alcohols or glycols.

The invention thus provides aqueous fabric softeners comprising one or a mixture of the compounds of the general formula (I)

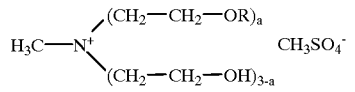

in which R is the radical of a fatty acid having from 14 to 18 carbon atoms, said compound or mixture having an iodine number in the range 15–25 and a=1, 2 or 3.

DETAILED DESCRIPTION OF THE INVENTION

The quaternary compounds of the general formula I which are used according to the invention are prepared by the processes generally known in this field by esterification of triethanolamine with fatty acid and subsequent quaternization.

The fatty components used for the esterification or transesterification are the monobasic fatty acids based on natural vegetable and animal oils having, in particular 14–18 carbon atoms which are customary and known in this field, such as tallow fatty acids and palm fatty acids and the methyl or ethyl esters thereof.

The content of unsaturated components in these fatty acids or fatty acid esters is, if necessary, adjusted to iodine numbers between 15–25 by the known catalytic hydrogenation processes, or achieved by mixing completely hydrogenated fatty components with nonhydrogenated fatty components.

The iodine number, as a measure of the average degree of saturation of a fatty acid, is the amount of iodine which is taken up by 100 g of the compound to saturate the double bonds.

Preference is given according to the invention to partially hydrogenated tallow fatty acids and palm fatty acids having iodine numbers between 15–25. They are commercially available products and are supplied by various companies under their respective tradenames.

The esterification or transesterification is carried out by known processes. In this connection, the triethanolamine is reacted with the amount of fatty acid or fatty acid ester corresponding to the desired degree of esterification, optionally in the presence of a catalyst, e.g. methanesulfonic acid, under nitrogen at 160–240° C., and the water of reaction which forms and the alcohol is continuously distilled off, it being possible to bring the reaction to completion by, if necessary, reducing the pressure.

The subsequent quaternization is also carried out by known processes. According to the invention, the process preferably involves adding equimolar amounts of the quaternizing agent to the ester, optionally with co-use of a solvent, preferably with, in particular, isopropanol, ethanol, 1,2-propylene glycol and/or dipropylene glycol, at 60–90° C. with stirring, if necessary under pressure, and monitoring completion of the reaction by checking the overall amine number.

Examples of quaternizing agents which can be co-used are short-chain dialkyl phosphates and sulfates, such as diethyl sulfate, dimethyl phosphate, diethyl phosphate and short-chain halogenated hydrocarbons; in particular, dimethyl sulfate is used according to the invention.

To prepare the quaternary ammonium compounds, triethanolamine (TEA) and fatty acids were reacted and quaternized by customary processes.

The fatty acids were:

Fatty acid 1:

Tallow fatty acid having an acid number of 200–210, an iodine number of 15–25 and a carbon chain distribution as follows:

| | |
|---|---|
| <C-16 | ca. 2% |
| C-16 | ca. 26% |
| C-16' | ca. 2% |
| C-17 | ca. 3% |
| C-18 | ca. 48% |
| C-18' | ca. 15% |
| C-18" | <1% |

Fatty acid II

Palm fatty acid having an acid number of 205–215, an iodine number of 15–25 and a carbon chain distribution as follows:

| | |
|---|---|
| <C-16 | ca. 3% |
| C-16 | ca. 47% |
| C-16' | — |
| C-17 | — |
| C-18 | ca. 28% |
| C-18' | ca. 17% |
| C-18" | ca. 2% |
| >C-18 | ca. 2% |

Fatty acid III

Tallow fatty acid having an acid number of 200–210, an iodine number of 45–55 and a carbon chain distribution as follows:

| | |
|---|---|
| <C-16 | ca. 4% |
| C-16 | ca. 26% |
| C-16' | ca. 2% |
| C-17 | ca. 3% |
| C-18 | ca. 17% |
| C-18' | ca. 41% |
| C-18" | <4% |
| >C-18 | ca. 2% |

Quaternization was carried out with dimethyl sulfate.

Component A: TEA: fatty acid I: 1:2

Component B: TEA: fatty acid I: 1:1.6

Component C: TEA: fatty acid II: 1:2

Component D: TEA: fatty acid II: 1:1.6

Component E: TEA: fatty acid III: 1:2

Component F: TEA: fatty acid III: 1:1.6

The fabric softener is prepared by emulsification or dispersion of the respective individual components in water. In this connection, it is possible to use the methods which are customary in this field.

The process usually involves initially introducing water which has been preheated to about 10° C. below the clear melting point of the softener, dispersing one after the other, with thorough stirring, firstly dye solution, then antifoam emulsion, which is optionally required, and finally the clear melt of the individual softener. After some of an electrolyte solution has been added, perfume oil is metered in, followed by the remaining electrolyte solution, and the mixture is then left to cool to room temperature with stirring. The fabric softeners according to the invention may comprise the said components within the limits customary in this field, such as, for example, 15–22% by weight of the compounds of the general formula (I); 2–5% by weight of a solvent such as, in particular, isopropanol, ethanol, propylene glycol and dipropylene glycol; 0.5–1.5% by weight of an alkali metal salt and/or alkaline earth metal salt; 0.5– 1.5% by weight of perfume oil and topped up to 100% by weight (ad 100) with water.

Like the prior art fabric softeners, the novel softeners are added after the actual washing process in the final rinse. The use concentration is, after dilution with water, in the range 0.1–10 g of fabric softener per liter of treatment liquor, depending on the field of use.

Determination of the rewetting power

In accordance with DIN 53924, the test fabric (about 3 kg of cotton bulk fabric, 100% cotton; supplier: WFK-Testgewebe GmbH, Krdfeld) is washed twice using 100 g of test detergent in each case and then without detergent (in each case 95° C. program with prewash). The test fabric is hung up to dry at room temperature for one day. When dry, test strips measuring about 25 cm in length and 1.5 cm in width are cut out. It must be ensured that all test strips of one test series have the threads running the same way.

The test strips are marked with a ball-point pen. Holes are punched at both ends of the test strip; a border about 5 cm in width should be left at the edge of the fabric.

The beakers are initially charged with the corresponding amount of demineralized water, and 0.025%, based on the solids content, of the product to be tested is stirred in. A control experiment is carried out by initially introducing demineralized water into the dipping bath.

In each case, 10 test strips are introduced into these liquors, stirred for 5 min at about 50 rpm using a magnetic stirrer and then left for 5 min without stirring.

The test strips are then hung up to dry at room temperature for 24 h. After this time, a line parallel to the long outer edges is drawn on the smooth side of each of the strips using a water-soluble felt-tip pen.

The test strips treated in this way (control+test product(s)) are attached to the immersion device. It must be ensured that the strips do not become elongated. The immersion device with the strips is placed into the tank filled with demineralized water (corresponds to about 10 l) to a height of 8 cm and left there for 5 min. 10 min after the immersion device has been removed from the tank the level reached by water, which can be seen from the migrating felt tip pen dye, is determined in mm. It must be ensured that the lower holed edge on the upper side contacts directly with the (hanging) hooks in order to avoid reading errors. The demineralized water must be replaced after each experiment.

Evaluation

According to the invention, this method may result in slight scattering, which must be taken into consideration in the calculation by indicating the standard deviation.

$$\text{Calculation: Rewetting power (\%)} = \frac{\text{Height reached by } A \text{ in mm} \times 100}{\text{Height reached by } BW \text{ in mm}}$$

BW: The arithmetic mean of the height reached by water (dye) in mm for the controls A: The arithmetic mean of the height reached by the water (dye) in mm for the samples of a fabric softener Carrying out the handle test 3 kg of the test fabric ("Duosoft" fabric, 100% cotton; supplier: Vossen) are washed 2×100 g of test detergent and then twice without detergent (in each case 95° C. program with prewash, time approximately 2 h); spinning speed: 1200 rpm.

A fixed predetermined liquor volume of 15 l (Miele W 719) results in a liquor ratio of 5:1. After washing, the test fabric is hung up to dry at room temperature for one day and then stored at room temperature until treated.

To immerse the fabric, the calculated amounts of the fabric softener are introduced into the beakers at 15–20° C. and made up to 2 l with tap water which has a German hardness of about 90 and is at 15–20° C. The mixture is then stirred on a magnetic stirrer until homogeneous dispersions or solutions form.

A control is carried out by introducing only tap water in the immersion bath. One section of test fabric is immersed per rinsing bath. After 10 min, the fabric is taken out of the rinsing bath, lightly wrung out, lightly shaken three times and hung up to dry as a single layer for 48 h at room temperature.

The test fabric treated in this way is cut into 10 equal sections (about 16×25 cm). Each test subject is given a new test section for assessment. It is important to prevent the test sections from becoming "soft through handling" after several handle tests.

The test fabrics treated with different fabric softeners are now compared in pairs. The evaluation consists in the test subjects assigning whole points between 0 and 5, 0 points indicating poor (hard) and 5 points indicating good (soft).

Evaluation

The differences between the individual pairs are in each case placed in the second column (difference points).

The difference is then assigned to the better product. The more difference points a product has, the better its handle.

EXAMPLES

According to this process (batch process), said components are used to prepare dispersions:

| | |
|---|---|
| Example 1: | |
| 22.0 g | of component A |
| 0.60 g | of dye (1% solution of SANDOLAN ® Walkblau NBL 150 from Sandoz) |
| 0.20 g | of antifoam (SAG 220 from OSi) |
| 0.80 g | of Fragrance ® perfume oil (D 60515 W from Haarmann and Reimer GmbH) |
| 0.20 g | of $CaCl_2$ |
| ad 100 | of water, 9° German hardness |
| Example 2: | |
| 19.2 g | of component B |
| 0.60 g | of dye (1% solution of SANDOLAN ® Walkblau NBL 150 from Sandoz) |
| 0.20 g | of antifoam (SAG 220 from OSi) |
| 0.80 g | of Fragrance ® perfume oil (D 60515 W from Haarmann and Reimer GmbH) |
| 0.20 g | of $CaCl_2$ |
| ad 100 | of water, 9° German hardness |
| Example 3: | |
| 22.0 g | of component C |
| 0.60 g | of dye (1% solution of SANDOLAN ® Walkblau NBL 150 from Sandoz) |
| 0.20 g | of antifoam (SAG 220 from OSi) |
| 0.80 g | of Fragrance ® perfume oil (D 60515 W from Haarmann and Reimer GmbH) |
| 0.20 g | of $CaCl_2$ |
| ad 100 | of water, 9° German hardness |
| Example 4: | |
| 19.2 | of component D |
| 0.60 g | of dye (1% solution of SANDOLAN ® Walkblau NBL 150 from Sandoz) |
| 0.20 g | of antifoam (SAG 220 from OSi) |
| 0.80 g | of Fragrance ® perfume oil (D 60515 W from Haarmann and Reimer GmbH) |
| 0.20 g | of $CaCl_2$ |
| ad 100 | of water, 9° German hardness |

-continued

| | |
|---|---|
| Comparative Examples | |
| Example 5: | |
| 22.0 g | of component E |
| 0.60 g | of dye (1% solution of SANDOLAN ® Walkblau NBL 150 from Sandoz) |
| 0.20 g | of antifoam (SAG 220 from OSi) |
| 0.80 g | of Fragrance ® perfume oil (D 60515 W from Haarmann and Reimer GmbH) |
| 0.20 g | of $CaCl_2$ |
| ad 100 | of water, 9° German hardness |
| Example 6: | |
| 19.2 g | of component F |
| 0.60 g | of dye (1% solution of SANDOLAN ® Walkblau NBL 150 from Sandoz) |
| 0.20 g | of antifoam (SAG 220 from OSi) |
| 0.80 g | of Fragrance ® perfume oil (D 60515 W from Haarmann and Reimer GmbH) |
| 0.20 | of $CaCl_2$ |
| ad 100 | of water, 9° German hardness |

Results

TABLE 1

| | Handle (points) | Rewetting power [%] |
|---|---|---|
| Component A | 42 | 56 |
| Component B | 40 | 58 |
| Component C | 40 | 61 |
| Component D | 38 | 63 |
| Component E | 32 | 62 |
| Component F | 29 | 65 |

TABLE 2

| | Handle (difference points) |
|---|---|
| Component A:Component B | 6:4 |
| Component A:Component C | 6:4 |
| Component A:Component D | 5:1 |
| Component A:Component E | 10:0 |
| Component A:Component F | 13:0 |
| Component B:Component C | 6:6 |
| Component B:Component D | 5:3 |
| Component B:Component E | 9:1 |
| Component B:Component F | 11:0 |
| Component C:Component D | 6:4 |
| Component C:Component E | 10:2 |
| Component C:Component F | 11:0 |
| Component D:Component E | 8:2 |
| Component D:Component F | 10:1 |
| Component E:Component F | 6:3 |

What Is claimed Is:

1. An aqueous fabric softener comprising a product of esterification of triethanolamine and a partially hydrogenated fatty acid having from 14 to 18 carbon atoms and an iodine number in the range of 15 to 25 wherein the ratio of triethanolamine to fatty acid is in the range of 1:1.6 to 1:2, wherein said esterification product is quaternized with dimethyl sulfate or dimethyl phosphate.

2. The aqueous fabric softener as claimed in claim 1 in which said partially hydrogenated fatty acid is partially hydrogenated tallow fatty acid or partially hydrogenated palm fatty acid having an iodine number of from 15 to 20.

* * * * *